US008151380B2

(12) United States Patent
Johnson et al.

(10) Patent No.: US 8,151,380 B2
(45) Date of Patent: Apr. 10, 2012

(54) WHEELCHAIR WITH ENHANCED TOILET ACCESSIBILITY

(76) Inventors: Gregory Johnson, Tea, SD (US); Quentine E Larson, Pollock, SD (US)

( * ) Notice: Subject to any disclaimer, the term of this patent is extended or adjusted under 35 U.S.C. 154(b) by 57 days.

(21) Appl. No.: 12/719,239

(22) Filed: Mar. 8, 2010

(65) Prior Publication Data

US 2010/0156064 A1 Jun. 24, 2010

Related U.S. Application Data

(63) Continuation-in-part of application No. 11/286,618, filed on Nov. 23, 2005, now Pat. No. 7,793,364.

(51) Int. Cl.
*A47K 11/06* (2006.01)
*A61G 7/02* (2006.01)

(52) U.S. Cl. ..... 4/480

(58) Field of Classification Search ..... 4/239, 480; 280/42, 250.1; 297/42, 45, 118
See application file for complete search history.

(56) References Cited

U.S. PATENT DOCUMENTS

| | | | | |
|---|---|---|---|---|
| 2,086,550 | A * | 7/1937 | Hartig | 4/480 |
| 3,061,368 | A * | 10/1962 | Matthews | 297/118 |
| 3,271,785 | A * | 9/1966 | Du Bose | 4/480 |
| 4,343,482 | A * | 8/1982 | Wegner | 4/480 |
| 4,514,867 | A * | 5/1985 | Jensen | 4/480 |
| 6,733,024 | B1 * | 5/2004 | Savegnago | 4/480 |

* cited by examiner

*Primary Examiner* — Tuan N Nguyen
(74) *Attorney, Agent, or Firm* — Mark A. Ekse

(57) ABSTRACT

A wheelchair with enhanced toilet access which facilitates independent use of the wheelchair by the user without intervention by caregivers. The wheelchair with enhanced toilet access includes a frame which includes a pair of laterally-separated side frame portions, with primary wheels as well as at least one secondary wheel rotatably mounted on the frame. A seat extends between the side frame portions, and includes a stationary portion and a movable portion.

18 Claims, 6 Drawing Sheets

WHEELCHAIR WITH ENHANCED TOILET ACCESSIBILITY

CROSS-REFERENCE TO RELATED APPLICATIONS

This application is a Continuation-In-Part of application Ser. No. 11/286,618.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON COMPACT DISC

Not Applicable.

BACKGROUND OF THE INVENTION

1. Field of the Invention

The present invention relates to wheelchairs and more particularly pertains to a new wheelchair that includes features that permit the user to use a toilet while remaining seated on the wheelchair.

2. Description of the Prior Art

The movement of a person with physical limitations from a wheelchair to a commode or toilet has long been recognized as a potentially dangerous operation for the person, and it has become more apparent that this movement can also be hazardous to the caregiver or other person seeking to assist the physically-limited person. This has become especially apparent in care facilities such as hospitals and nursing homes, where the caregiver may be strained or injured when lifting the patient from the wheelchair to the toilet or from the toilet back to the wheelchair. Should the caregiver lose his or her hold on the patient during the transfer and the patient falls, both patent and caregiver may be injured.

There have been a number of proposals set forth in the art that attempt to address this problem by providing a wheelchair that the user does not have to move from when the user uses the toilet.

These proposals have included removable trays or bedpans integrated into the chair that are located below holes in the seating area that may or may not be closable between toilet uses, but this approach is not very feasible for the physically limited person trying to live independently without constant assistance by a caregiver, and may present sanitary concerns.

Also, removable seat panels have been proposed that slide forwardly or rearwardly away from the rest of the seat to create an opening. While this approach is functional, the ability of the physically-impaired user of the chair to slide the seat panel forwardly from underneath himself or herself is doubtful, and rearward sliding of the panel may be virtually impossible. Thus, these proposals are not the best for those persons seeking to live independently and not having the constant services of a caregiver, and even present difficulties for those in care facilities that wish to function independently to the greatest extent possible.

Thus, it appears that the majority, if not all, of the known prior art proposals have not taken into account the physically limited condition of the users of the typical wheelchair user and the resulting designs are not very "user-friendly" if one considers the user to be the person using the wheelchair who wishes to function as independently as possible.

In these respects, it is believed that the wheelchair according to the present invention substantially departs from the concepts and designs of the known prior art, and in so doing provides a wheelchair with enhanced capabilities for being operated independently by the user of the wheelchair to facilitate independent living by the user.

SUMMARY OF THE INVENTION

In view of the foregoing disadvantages inherent in the known types of wheelchairs now present in the prior art, the present invention provides a new wheelchair that facilitates independent use of the wheelchair by the user without intervention by caregivers.

To attain this, the present invention generally comprises a wheelchair with enhanced toilet access that has a frame which includes a pair of laterally-separated side frame portions, with primary wheels as well as at least one secondary wheel rotatably mounted on the frame. A seat extends between the side frame portions, and includes a stationary portion and a movable portion. The stationary portion has an opening and the movable portion is positionable in the opening. The movable portion is pivotable between a normal position that closes the opening in the stationary portion and a dropped position that opens the opening in the stationary portion. A seat moving mechanism is configured to move the movable portion of the seat with respect to the stationary portion to thereby move the movable portion between the normal and dropped positions.

In some embodiments, a space is formed between the side frame portions of the frame and below the seat, with the space being capable of receiving a bowl portion of a toilet when the frame is moved rearwardly over the bowl portion so that at least a portion of the opening in the stationary portion of the seat is positioned over the bowl portion of the toilet.

In some embodiments, the seat moving mechanism includes an actuating handle that is movable between a normal position and a dropped position. The normal position of the handle corresponds to the normal position of the movable portion of the seat and the dropped position of the handle corresponds to the dropped position of the movable portion of the seat. The normal position and the dropped position of the actuating handle are characterized by a major portion of the handle being positioned at vertical level substantially the same as or higher than a vertical level of the seat.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
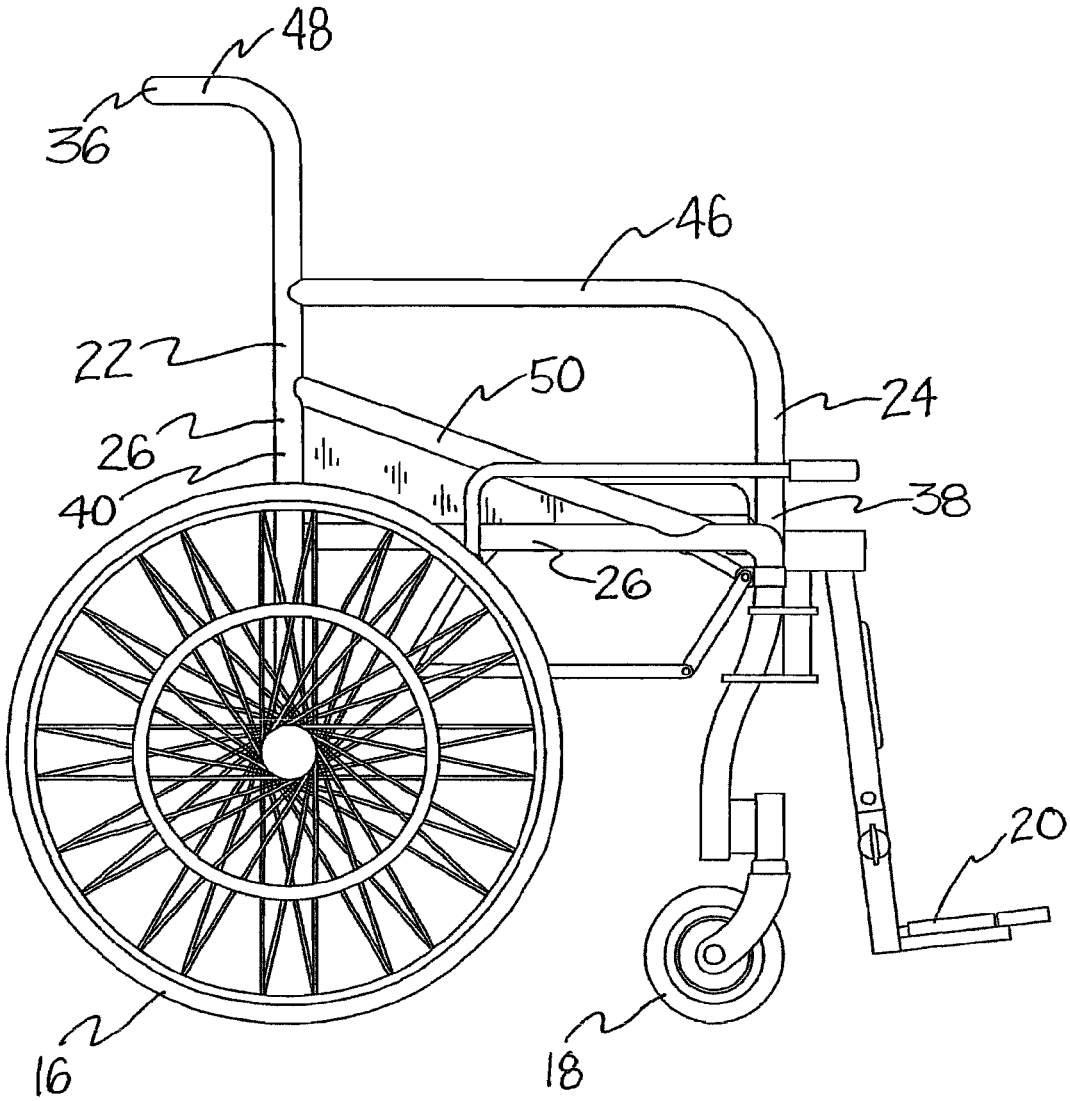
FIG. 1 is a schematic side view of a new wheelchair with enhanced toilet accessibility according to the present invention.
Figure 2:
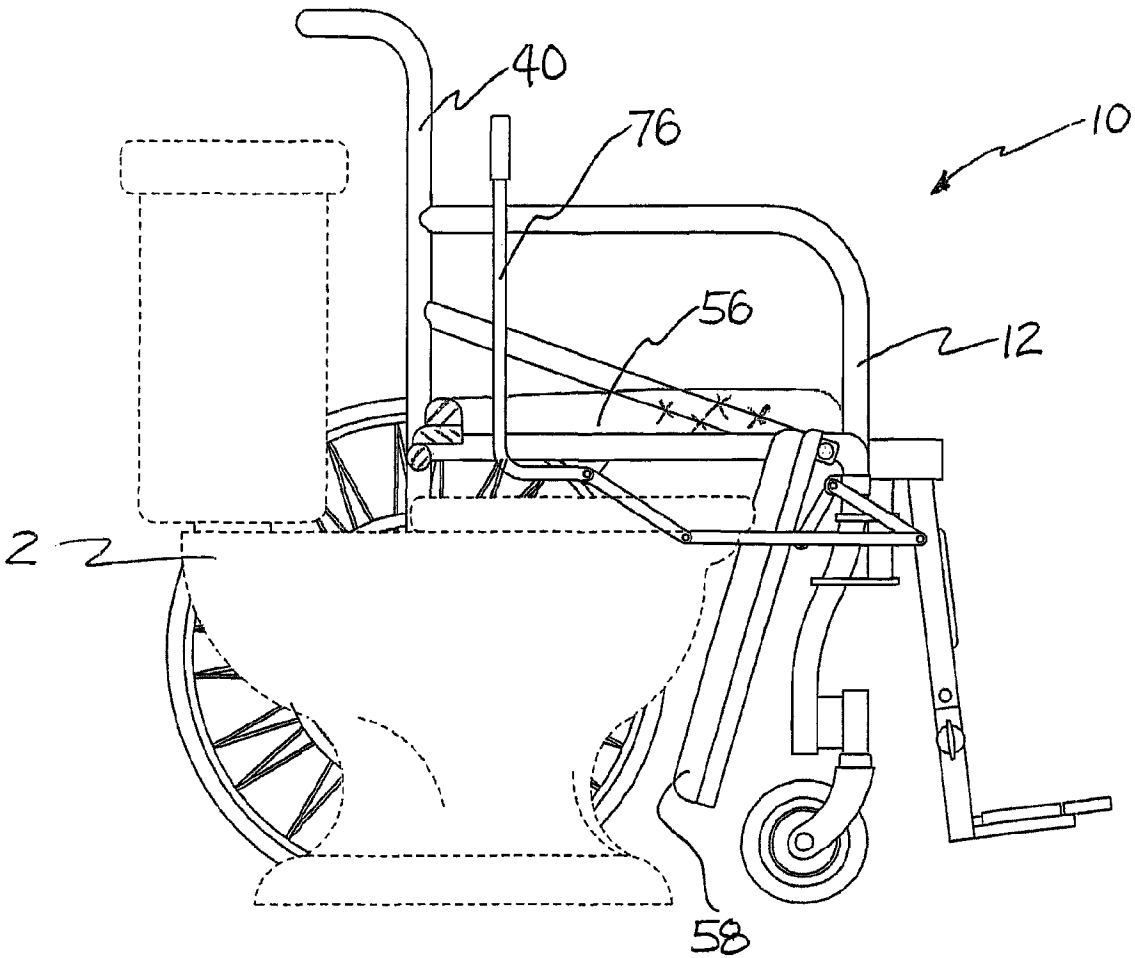
FIG. 2 is a schematic side view of the present invention shown with the movable portion of the seat in the dropped position and shown in relation to a toilet.
Figure 3:
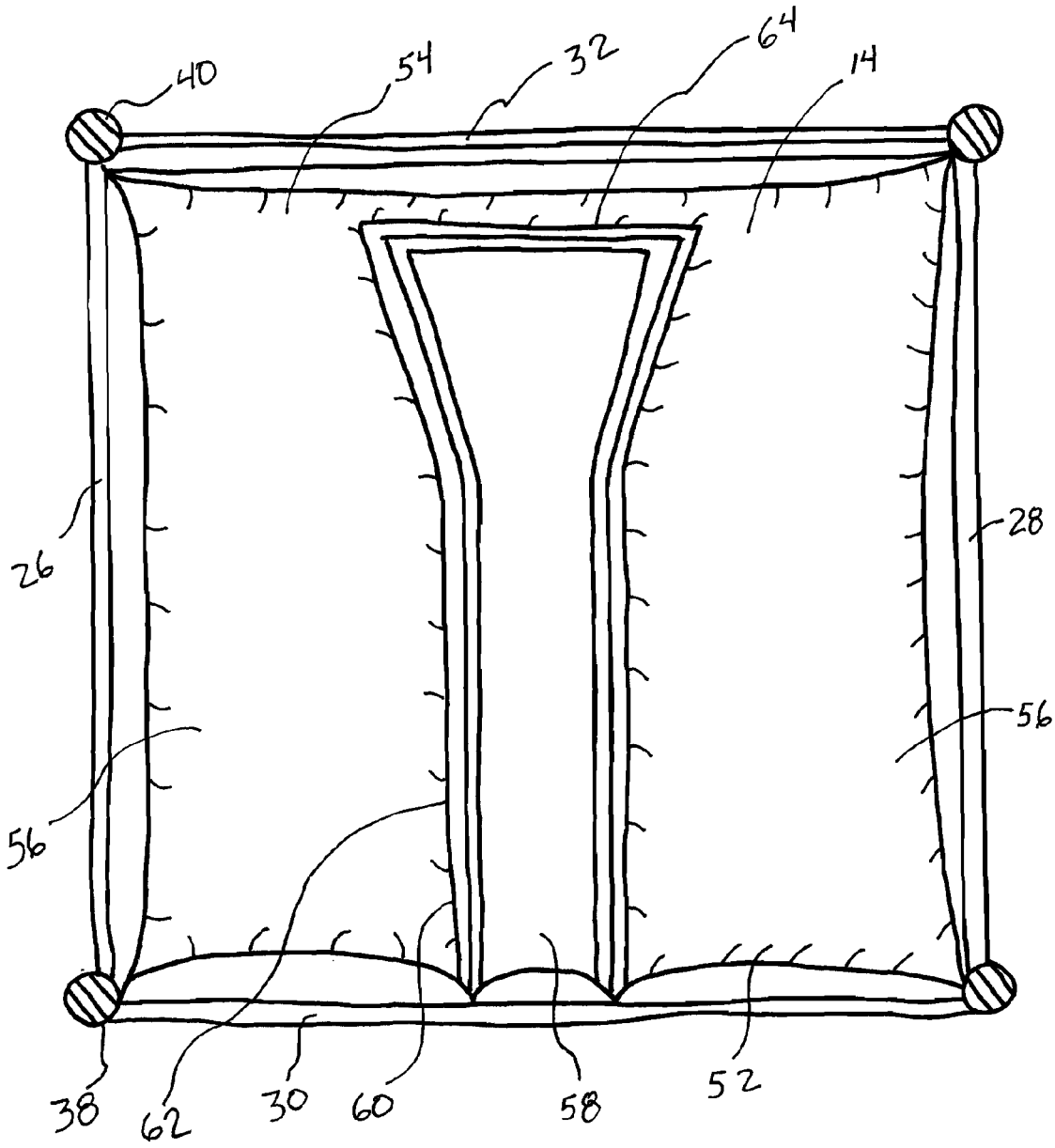
FIG. 3 is a schematic top view of the seat of the present invention particularly illustrating the movable portion and the stationary portion.
Figure 4:
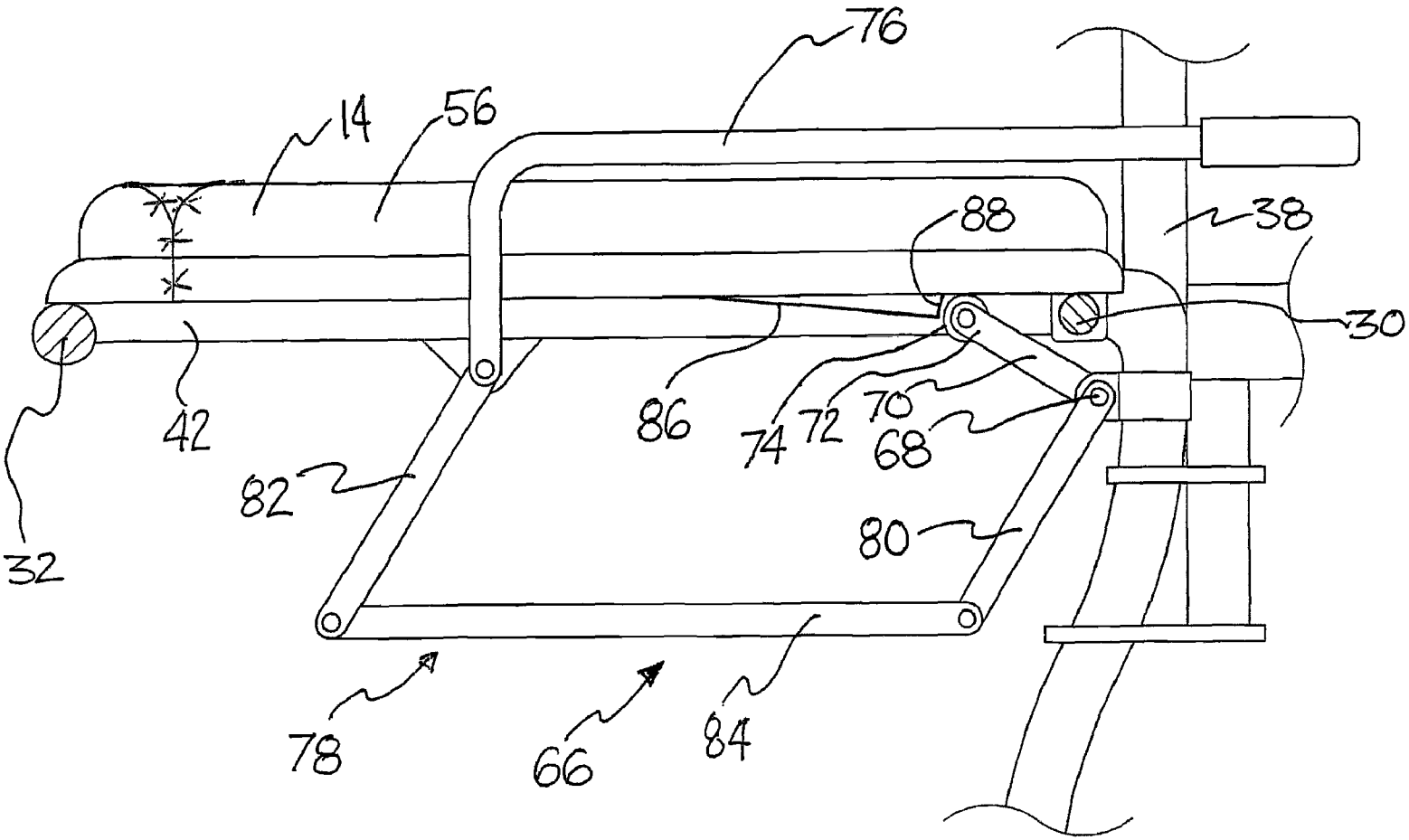
FIG. 4 is a schematic side view of a portion of the wheelchair of the present invention showing the movable portion of the seat in the normal usage position.
Figure 5:
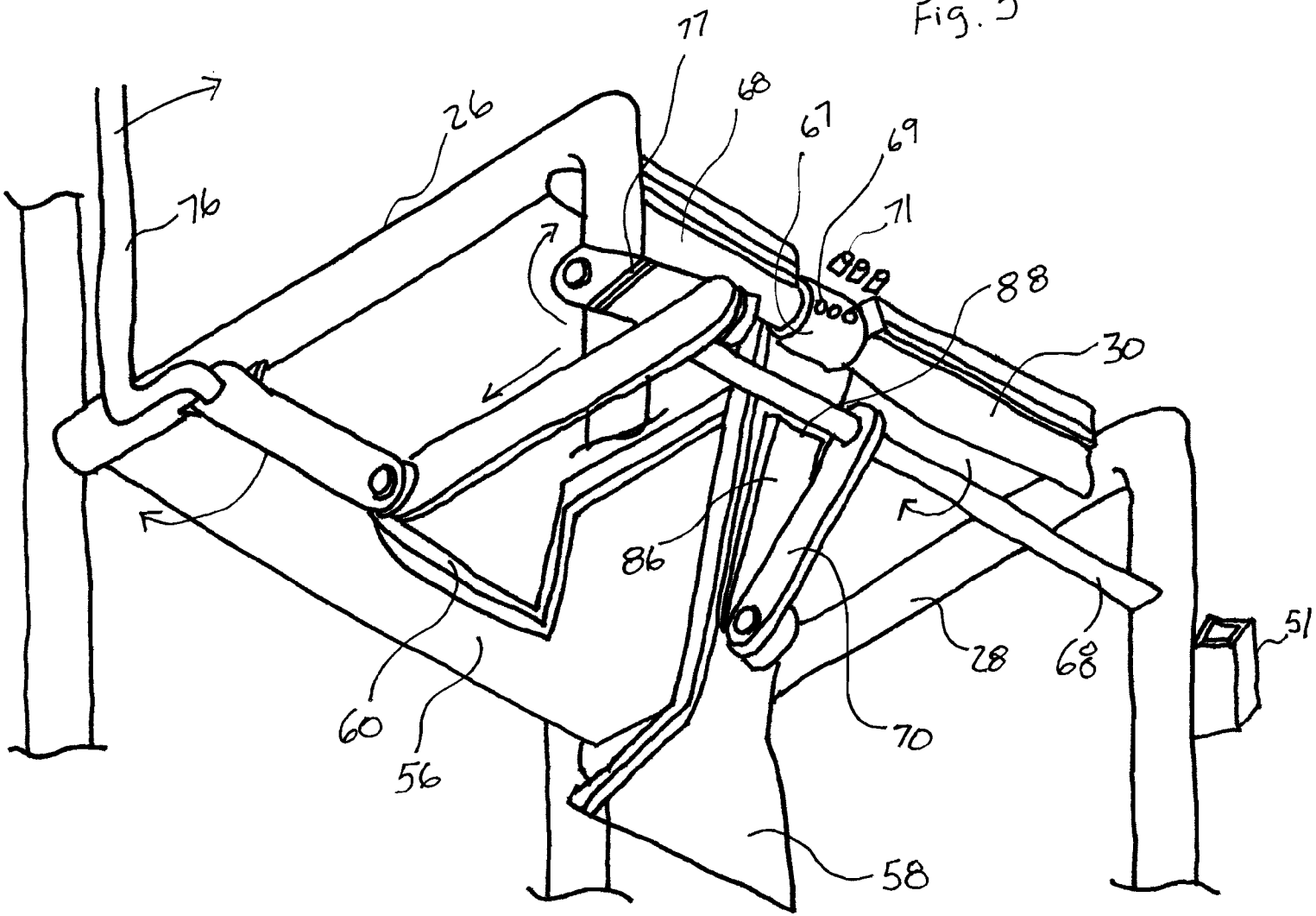
FIG. 5 is a schematic side view of the portion of the wheelchair shown in FIG. 4 with the movable portion of the seat in a medial position between the normal and dropped positions.
Figure 6:
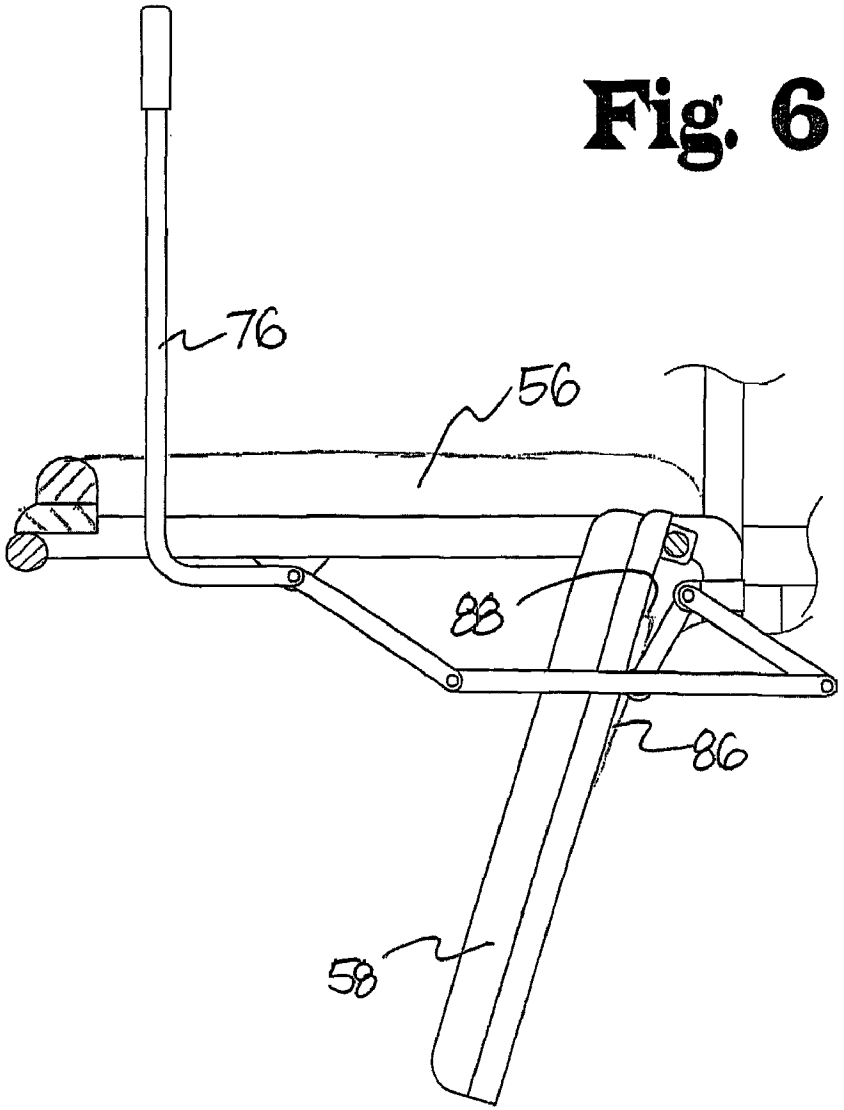
FIG. 6 is a schematic side view of the portion of the wheelchair shown in FIGS. 4 and 5 with the movable portion of the seat in the dropped position.

With reference now to the drawings, and in particular to FIGS. 1 through 6 thereof, a new wheelchair with enhanced toilet accessibility embodying the principles and concepts of the present invention and generally designated by the reference numeral 10 will be described.

The wheelchair 10 of the invention provides the user with enhanced access to a commode or toilet 2 by permitting the user to use the toilet without having to move, or be moved from the seat of the chair 10, as well as providing a mechanism for opening the seat for toilet access that can be relatively easily actuated or moved by the user while seated in the chair and with relatively little reaching and requiring a minimal amount of upper body strength.

The wheelchair 10 of the invention includes a frame 12, which supports a seat 14, a pair of primary wheels 16 that are rotatably mounted on the frame 12, a pair of secondary wheels 18 that are rotatably and optionally swivelably mounted on the frame, and a pair of foot supports 20 that are also mounted on the frame. The primary wheels 16 may be mounted on the rear 22 of the frame 12 and the secondary wheels are mounted on the front 24 of the frame, although other arrangements of the wheels may be employed.

The frame 12 of the invention may include a pair of side frame portions 26, 28 that are laterally spaced from each other. Each of the side frame portions 26, 28 has a front and a rear that generally corresponds to the front 24 and the rear 22 of the wheelchair. Significantly, the area or space between the side frame portions 26, 28 is substantially open and clear of obstruction below the level of the seat 14 and rearward of the front of the frame 12, so that a portion of a toilet bowl may. be moved between the side frame portions, so that a portion of the seat 14 is positioned above the bowl of the toilet 2. The portion of the seat 14 that is located above the toilet may be at least one-half of the front to back length of the seat, and may be as much as 60 percent to 70 percent of the front to back length of the seat.

The frame 12 may further include a forward linking member 30 that extends between the side frame positions 26, 28. The forward linking member 30 may be located toward the front of the seat 14, and may extend in a substantially horizontal orientation. The frame 12 may also include a rearward linking member 32 that extends between the side frame portions. The rearward linking member 32 may be positioned at the rear of the seat 14, and may extend in a substantially horizontal orientation. Optionally, the frame 12 may further include a secondary forward linking member (not shown) that extends between the side frame portions 26, 28. The secondary forward linking member may be located below the forward linking member 30 and may also extend in a substantially horizontal orientation. A handle member 36 may extend between the side frame portions 26, 28 toward the rear 22 of the wheelchair frame 12 to link the frame portions and form a handle for being gripped by a person desiring to push or pull the wheelchair.

Each of the side frame portions 26, 28 may comprise a forward member 38 located toward the front 24 of the frame and a rearward member 40 located toward the rear 22 of the frame. The forward 38 and rearward 40 members may each extend in a substantially vertical orientation. Each side frame portion 26, 28 may include a seat support member 42, which may extend between the forward 38 and rearward 40 members of the respective side frame portion. Each side frame portion 26, 28 may also include a rear wheel support member 44 that extends from the seat support member 42 to the rearward member 40, and may extend downwardly and rearwardly from the seat support member to the rearward member. Each side frame portion 26, 28 may also include an armrest member 46 that extends between the forward member 38 and the rearward member 40, and a handle support member 48 that is mounted on the rearward member and extends rearwardly from the rearward member. Both the armrest member 46 and the handle support member 48 may be substantially horizontally oriented. Further, a brace member 50 may extend between the rearward member 40 and the seat support member 42, and the brace member may extend downwardly from the rearward member to the seat support member.

The seat 14 of the invention extends between the side frame portions 26, 28, and has a front 52 and a rear 54. The seat 14 includes a stationary portion 56 and a movable portion 58. The stationary portion 56 has an opening 60. The movable portion 58 of the seat 14 is positionable in the opening 60. The movable portion 58 is configured to be capable of moving with respect to the stationary portion to open or unblock the central opening 60 in the stationary portion. The movable portion 58 of the seat has a normal position (see FIG. 4) in which the movable portion closes the opening in the stationary portion 56 as well as a dropped position (see FIGS. 2 and 6) in which the movable portion is moved out of the opening in the stationary portion. The movable portion 58 is most preferably pivotable with respect to the stationary portion, and pivots downwardly and forwardly from the stationary portion (see FIG. 5). The normal position is characterized by the movable portion 58 and the stationary portion 60 forming a substantially continuous seat surface, and the dropped position is characterized by the movable portion of the seat being moved out of the opening and into a position in which the movable portion is situated forwardly in the space between the side frame portions 26, 28. The movable portion 58 may be pivotable about the forward linking member 30 of the frame, which is generally positioned at the front 52 of the seat 14.

In at least one embodiment, the opening 60 may have a substantially keyhole shape, with an elongated portion 62 extending rearwardly from the front 52 of the seat toward the rear 54 of the seat, and an enlarged portion 64 that is connected to the elongated portion. The enlarged portion 64 of the opening is located rearwardly of the elongated portion 62. The movable portion 58 has an outer perimeter that generally corresponds to the shape of the opening 60 in the stationary portion to create a substantially continuous upper seat surface when the seat is in the normal position.

In an embodiment, the enlarged portion 64 may be substantially triangular. The length of the enlarged portion 64 is between twenty and fifty percent of a total length of the movable portion 58. More preferably, the length of the enlarged portion 64 is approximately one third of a total length of the movable portion 58.

In still a further embodiment the enlarged portion 64 has a proximal end 63 and a distal end 65. The proximal end 63 may include a width of between thirty and sixty percent of a width of distal end 65. More preferably, the proximal end 63 may include a width approximately one half of the distal end 65.

The invention may also include seat moving means or mechanism for moving the movable portion 58 of the seat 14 with respect to the stationary portion 56 of the seat. In one embodiment of the invention, the mechanism is selectively actuatable to move the movable portion 58 upwardly, such as from the dropped position to the normal position, and may simply move to permit gravity to act upon the weight of the movable portion and move the movable portion downwardly, although it is possible that the moving means could also pull the movable portion downwardly.

The seat moving mechanism comprises a lifting assembly 66 for applying upward pressure on the movable portion 58 of the seat 14. The lifting assembly 66 comprises a pivot shaft 68 pivotally mounted on the frame 12. The pivot shaft 68 may extend between the side frame portions 26, 28. The pivot shaft 68 has a pair of ends, and each of the ends is pivotally mounted on one of the side frame portions. The lifting assembly 66 may also include a swing arm 70 that is mounted on the pivot shaft. The swing arm 70 has a free end 72, and the swing arm may have a roller 74 that is mounted on the free end. The swing arm 70 may have a raised portion (see FIG. 4) in which the swing arm (and the roller 74 when employed) presses against the movable portion 58 of the seat in the normal position to hold the movable portion adjacent to the stationary portion. The swing arm 70 may have a lowered position (see FIG. 6) in which the swing arm 70 is moved away from the movable portion 58 of the seat in the normal position, so that the movable portion is essentially free to move downwardly under the effect of gravity.

The seat moving mechanism may include an actuating handle 76 movably mounted on the frame 12 for actuating the movable portion 58 of the seat. The actuating handle 76 may be pivotable with respect to the frame 12, and the handle may have a base end that is pivotally mounted on the frame 12, such as, illustratively, on the seat support member 42. The actuating handle 76 may be pivotable between a normal position (see FIG. 4), in which the movable portion 58 is in the normal portion, and a dropped position (see FIG. 6), in which the movable portion is in the dropped position.

Significantly, the features of the actuating handle of the invention make the handle more easily actuated by a user of the wheelchair without the assistance of a caregiver. In particular, in both the normal position and the dropped position of the actuating handle 76, a major portion of the handle 76 is positioned at vertical level above the seat, and even the top surface of the seat, so that the user sitting in the wheelchair is not required to reach below the seat to actuate the handle. The user is also able to drop the movable portion 58 by pulling the handle 76 upwardly toward the user's body, and pushes the handle away from the user's body to raise the movable portion. The handle 76 may also be movable in a plane positioned substantially parallel to one of the side frame portions 26, 28 of the frame, and substantially parallel to the armrest member 46. In one embodiment of the invention, the normal position of the handle 76 is characterized by a major portion of the actuating handle being substantially horizontally oriented, and the dropped position is characterized by the handle being substantially vertically oriented.

The seat moving mechanism may also include a linkage assembly 78 that links the actuating handle 76 to the lifting assembly 66 to transfer movement of the actuating handle to the lifting assembly. The linkage assembly 78 may comprise a first link 80 that is mounted to the pivot shaft 68, and the first link 80 is rotatable with the pivot shaft. The first link 80 may be mounted to the pivot shaft 68 toward an end of the pivot shaft. The linkage assembly 78 may also include a second link 82 that is mounted on the actuating handle 76 such that the second link moves with, and is rotated by movement of the handle 76. A connecting link 84 may connect the first 80 and second 82 links to transfer the movement of the second link to the first link when the handle 76 is actuated. Optionally, the configuration of the links may be such that the effort required by the user to actuate the handle 76, the linkage assembly 78, and the lifting assembly 66 is minimized such as, for example, by multiplying the magnitude of the force applied by the user to the handle.

In even still a further embodiment, a sleeve member 67 is positioned over the pivot shaft 68. The sleeve member 67 may include a plurality of apertures 69 extending through at least one wall of the sleeve member 67. Preferably, each aperture 69 is threaded. Each one of a plurality of set screw members 71 may be positioned in an associated one of the plurality of apertures 69 to secure the sleeve member to the pivot assembly.

In an embodiment the linkage assembly further comprises a stop block 77 operationally coupled to the linkage assembly 78. The stop block 77 may be positioned such that the actuating handle 76 abuts the stop block 77 to inhibit overextension of the actuating handle 76.

In one highly preferred option, a ramped surface member 86 may be positioned on the underside of the movable portion 58 so that the roller 74 moves over the ramped surface member as the swing arm 70 engages the movable portion as the movable portion moves from the dropped position to the normal position. In greater detail, a relatively thinner end of the ramped surface member 86 is positioned toward the rear 54 of the seat, and a relatively thicker end of the ramped surface member is positioned toward the front 52 of the seat, so that the roller 74 rolls over an increasingly thicker portion of the ramped surface member as the movable portion is moved from the dropped position to the normal position. As the movable portion 58 moves into the normal position, the roller 74 rolls across, and off of, the relatively thicker end of the ramped surface member 86. The relatively thicker end of the ramped surface member 86 may form a stop 88 against which the roller 74, or end of the swing arm 70, is positioned against when the movable portion is in the normal position, to help hold the movable portion in the normal position. To move the movable portion from the normal position to the dropped position, the roller or end of the swing arm must thus move over the stop 88, and thus sufficient force must be applied to the swing arm through the handle 76 and the linkage assembly to accomplish this. The ramped surface of the ramped surface member 86 facilitates the movement of the roller 74 over the stop 88. Optionally, a simple stop without a ramped surface member may also be employed.

In an embodiment, the wheelchair 10 also includes a pair of saddle members 51. Each one of the saddle members 51 may be operationally coupled to the frame 12 adjacent to either side of the seat 14. The saddle members 51 selectively receiving accessory assemblies, such as leg supports and foot rests.

In use, the user of the wheelchair, when desiring to use the toilet, may simply pull on the actuating handle 76 in an upward direction toward the user seated in the chair 10 to cause the movable portion of the seat to drop downwardly and forwardly to the dropped position. The user may then operate the wheels of the chair 10 to move the toilet between the side frame portions from the rear of the chair, so that the opening of the stationary portion of the seat is at least partially positioned above the bowl of the toilet. When the user is finished using the toilet, the user wheels the chair outwardly from the toilet so that the toilet is no longer located between the side frame portion, and the user then pushes the handle 76 away from himself or herself toward the normal position of the handle to bring the movable position of the seat into the normal position, until the roller of the swing arm moves over the stop 88 of the ramped surface member.

With respect to the above description then, it is to be realized that the optimum dimensional relationships for the parts of the invention, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Index of Elements for Wheelchair with Enhanced Toilet Accessibility

| | |
|---|---|
| 2. | toilet |
| 80. | First Link |
| 82. | Second Link |
| 84. | Connecting Link |
| 86. | Ramped Surface Member |
| 88. | Stop of Ramped Surface Member |
| 10. | Wheelchair |
| 11. | |
| 12. | Frame |
| 13. | |
| 14. | Seat |

-continued

| | |
|---|---|
| 15. | Height Adjustment Assembly |
| 16. | Primary Wheels |
| 17. | Apertures |
| 18. | Secondary Wheels |
| 19. | Axel Assembly |
| 20. | Foot Supports |
| 21. | Wheel Fork Assembly |
| 22. | Rear Of Frame |
| 23. | Pivot Block |
| 24. | Front Of Frame |
| 25. | |
| 26. | First Side Frame Portion |
| 27. | |
| 28. | Second Side Frame Portion |
| 29. | |
| 30. | Forward Linking Member |
| 31. | |
| 32. | Rearward Linking Member |
| 33. | |
| 34. | Side Members |
| 35. | Pan Member |
| 36. | Handle Member |
| 37. | |
| 38. | Forward Member |
| 39. | |
| 40. | Rearward Member |
| 41. | |
| 42. | Seat Support Member |
| 43. | |
| 44. | Rear Wheel Support Member |
| 45. | |
| 46. | Armrest Member |
| 47. | |
| 48. | Handle Support Member |
| 49. | |
| 50. | Brace Member |
| 51. | Saddle Member |
| 52. | Front of Seat |
| 53. | |
| 54. | Rear of Seat |
| 55. | |
| 56. | Stationary Portion Of Seat |
| 57. | |
| 58. | Movable Portion of Seat |
| 59. | |
| 60. | Opening in Stationary Portion of Seat |
| 61. | |
| 62. | Elongated Portion of Opening |
| 63. | Proximal End |
| 64. | Enlarged Portion of Opening |
| 65. | Distal end |
| 66. | Lifting Assembly |
| 67. | Sleeve Member |
| 68. | Pivot Shaft |
| 69. | Apertures |
| 70. | Swing Arm |
| 71. | Set Screws |
| 72. | Free End Of Swing Arm |
| 73. | |
| 74. | Roller |
| 75. | |
| 76. | Actuating Handle |
| 77. | Stop Block |
| 78. | Linkage Assembly |
| 79. | |

We claim:

1. A wheelchair with enhanced toilet access, comprising:

a frame having a front and a rear, the frame including a pair of laterally-separated side frame portions;

a pair of primary wheels rotatably mounted on the frame; at least one secondary wheel rotatably mounted on the frame;

a seat extending between the side frame portions, the seat having a front and a rear, the seat including a stationary portion and a movable portion, the stationary portion having an opening, the movable portion being positionable in the opening, the movable portion having a normal position that closes the opening in the stationary portion and a dropped position that opens the opening in the stationary portion, the movable portion of the seat being pivotably movable between the normal and dropped positions;

a seat moving mechanism configured to move the movable portion of the seat with respect to the stationary portion of the seat to thereby move the movable portion between the normal and dropped positions;

wherein the seat moving mechanism comprises:

a lifting assembly for applying upward pressure on the movable portion of the seat;

an actuating handle movably mounted on the frame, the handle being movable between a normal position and a dropped position;

a linkage assembly linking the actuating handle to the lifting assembly, the linkage assembly transferring movement of the actuating handle to the lifting assembly; and said linkage assembly further comprises a stop blocks operationally coupled to said linkage assembly, said stop block being positioned such that said actuating handle abuts said stop block to inhibit overextension of said actuating handle.

2. The wheelchair of claim 1, further comprising:

wherein the movable portion is pivotable downwardly and forwardly from the stationary portion when moved between the normal and stationary positions;

wherein the opening in the stationary portion has an elongated portion extending rearwardly from the front of the seat toward the rear of the seat and an enlarged portion connected to the elongated portion, the enlarged portion being located rearwardly of the elongated portion;

wherein the movable portion of the seat has an outer perimeter, and the outer perimeter of the movable portion generally corresponds to the shape of the opening in the stationary portion.

3. The wheelchair of claim 2, further comprising said enlarged portion being substantially triangular.

4. The wheelchair of claim 3, wherein a length of said enlarged portion is between twenty and fifty percent of a total length of said movable portion.

5. The wheelchair of claim 3, wherein a length of said enlarged portion is approximately one third of a total length of said movable portion.

6. The wheelchair of claim 3, wherein said enlarged portion has a proximal end and a distal end, said proximal end having a width of between thirty and sixty percent of a width of distal end.

7. The wheelchair of claim 3, wherein said enlarged portion has a proximal end and a distal end, said proximal end having a width approximately one half of said distal end.

8. The wheelchair of claim 1 , wherein the lifting assembly comprises:

a pivot shaft pivotally mounted on the frame;

a swing arm mounted on the pivot shaft, the swing arm having a free end, the swing arm having a raised position in which the swing arm presses against the movable portion of the seat in the normal position, the swing arm having a lowered position in which the swing arm is moved away from the movable portion of the seat in the normal position; and the swing arm has a roller mounted thereon for contacting the movable portion of the seat.

9. The wheelchair of claim 8, further comprising:

a sleeve member positionable over said pivot shaft, said sleeve member having a plurality of apertures extending through at least one wall of said sleeve member, each aperture being threaded;

a plurality of set screw members, each one of said plurality of set screw members being positionable in an associated one of said plurality of apertures to secure said sleeve member to said pivot assembly.

10. The wheelchair of claim 1, further comprising a pair of height adjustment assemblies, each one of said pair of height adjustment assemblies being operationally coupled between an associated one of said pair of primary wheels and said frame, whereby a height of the frame above the ground is adjustable.

11. The wheelchair of claim 10, wherein each one of said pair of height adjustment assemblies each further comprise a plurality of apertures, said plurality of apertures being positioned in a vertical array.

12. The wheelchair of claim 11, wherein said plurality of apertures includes at least one aperture positioned forward of at least one other aperture, whereby the position of the primary wheels may be adjusted fore and aft relative to the frame.

13. The wheelchair of claim 1, wherein each one of said plurality of secondary wheels further comprises:

an axel assembly for operationally coupling to said frame;

a wheel fork assembly including a wheel fork member and a wheel, rotatably coupled to said wheel for member; and a pivot block assembly, said pivot block assembly providing a coupling interface between said axel assembly and said wheel fork assembly, said pivot block assembly being pivotally coupleable to said wheel fork assembly and rotatably coupleable to said axel assembly, whereby said wheel member may pivot 360 degrees around an axis defined by said axel assembly in addition to rotating around it own axis.

14. The wheelchair of claim 1, further comprising:

a pair of slide members operationally coupleable to an underside of said stationary portion of said seat adjacent to said movable portion of said seat;

a pan member selectively positionable between said pair of slide members when said movable portion is in a dropped position, said pan member being for receiving human waste when a toilet is not available.

15. The wheelchair of claim 1, further comprising a pair of saddle members, each one of the saddle members being operationally coupled to the frame adjacent to either side of the seat, said saddle members selectively receiving accessory assemblies.

16. The wheelchair of claim 1, further comprising:

wherein the movable portion is pivotable downwardly and forwardly from the stationary portion when moved between the normal and stationary positions;

wherein the opening in the stationary portion has an elongated portion extending rearwardly from the front of the seat toward the rear of the seat and an enlarged portion connected to the elongated portion, the enlarged portion being located rearwardly of the elongated portion;

wherein the movable portion of the seat has an outer perimeter, and the outer perimeter of the movable portion generally corresponds to the shape of the opening in the stationary portion;

said enlarged portion being substantially triangular;

wherein a length of said enlarged portion is between twenty and fifty percent of a total length of said movable portion and said enlarged portion has a proximal end and a distal end, said proximal end having a width of between thirty and sixty percent of a width of distal end;

wherein the linkage assembly further comprises a stop blocks operationally coupled to said linkage assembly, said stop block being positioned such that said actuating handle abuts said stop block to inhibit overextension of said actuating handle;

wherein the lifting assembly comprises:

a pivot shaft pivotally mounted on the frame;

a swing arm mounted on the pivot shaft, the swing arm having a free end, the swing arm having a raised position in which the swing arm presses against the movable portion of the seat in the normal position, the swing arm having a lowered position in which the swing arm is moved away from the movable portion of the seat in the normal position;

the swing arm has a roller mounted thereon for contacting the movable portion of the seat;

a sleeve member positionable over said pivot shaft, said sleeve member having a plurality of apertures extending through at least one wall of said sleeve member, each aperture being threaded; and a plurality of set screw members, each one of said plurality of set screw members being positionable in an associated one of said plurality of apertures to secure said sleeve member to said pivot assembly.

17. The wheelchair of claim 16, further comprising a pair of height adjustment assemblies, each one of said pair of height adjustment assemblies being operationally coupled between an associated one of said pair of primary wheels and said frame, whereby a height of the frame above the ground is adjustable;

wherein each one of said pair of height adjustment assemblies each further comprise a plurality of apertures, said plurality of apertures being positioned in a vertical array;

wherein said plurality of apertures includes at least one aperture positioned forward of at least one other aperture, whereby the position of the primary wheels may be adjusted fore and aft relative to the frame;

wherein each one of said plurality of secondary wheels further comprises:

an axel assembly for operationally coupling to said frame;

a wheel fork assembly including a wheel fork member and a wheel, rotatably coupled to said wheel for member;

a pivot block assembly, said pivot block assembly providing a coupling interface between said axel assembly and said wheel fork assembly, said pivot block assembly being pivotally coupleable to said wheel fork assembly and rotatably coupleable to said axel assembly, whereby said wheel member may pivot 360 degrees around an axis defined by said axel assembly in addition to rotating around it own axis;

a pair of slide members operationally coupleable to an underside of said stationary portion of said seat adjacent to said movable portion of said seat;

a pan member selectively positionable between said pair of slide members when said movable portion is in a dropped position, said pan member being for receiving human waste when a toilet is not available; and a pair of saddle members, each one of the saddle members being operationally coupled to the frame adjacent to either side of the seat, said saddle members selectively receiving accessory assemblies.

18. A wheelchair with enhanced toilet access, comprising:

a frame having a front and a rear, the frame including a pair of laterally-separated side frame portions;

a pair of primary wheels rotatably mounted on the frame; at least one secondary wheel rotatably mounted on the frame;

a seat extending between the side frame portions, the seat having a front and a rear, the seat including a stationary portion and a movable portion, the stationary portion having an opening, the movable portion being positionable in the opening, the movable portion having a normal position that closes the opening in the stationary portion and a dropped position that opens the opening in the stationary portion, the movable portion of the seat being pivotably movable between the normal and dropped positions;

a seat moving mechanism configured to move the movable portion of the seat with respect to the stationary portion of the seat to thereby move the movable portion between the normal and dropped positions;

wherein the movable portion is pivotable downwardly and forwardly from the stationary portion when moved between the normal and stationary positions;

wherein the opening in the stationary portion has an elongated portion extending rearwardly from the front of the seat toward the rear of the seat and an enlarged portion connected to the elongated portion, the enlarged portion being located rearwardly of the elongated portion;

wherein the movable portion of the seat has an outer perimeter, and the outer perimeter of the movable portion generally corresponds to the shape of the opening in the stationary portion;

said enlarged portion being substantially triangular;

wherein a length of said enlarged portion is approximately one third of a total length of said movable portion;

wherein said enlarged portion has a proximal end and a distal end, said proximal end having a width approximately one half of said distal end;

wherein the seat moving mechanism comprises a lifting assembly, an actuating handle, and a linkage assembly, said lifting assembly for applying upward pressure on the movable portion of the seat, said actuating handle movably mounted on the frame, the handle being movable between a normal position and a dropped position, and said linkage assembly linking the actuating handle to the lifting assembly, the linkage assembly transferring movement of the actuating handle to the lifting assembly;

wherein the linkage assembly further comprises a stop blocks operationally coupled to said linkage assembly, said stop block being positioned such that said actuating handle abuts said stop block to inhibit overextension of said actuating handle;

said lifting assembly comprises a pivot shaft and a swing arm, said pivot shaft pivotally mounted on the frame, said swing arm mounted on the pivot shaft, the swing arm having a free end, the swing arm having a raised position in which the swing arm presses against the movable portion of the seat in the normal position, the swing arm having a lowered position in which the swing arm is moved away from the movable portion of the seat in the normal position, said swing arm has a roller mounted thereon for contacting the movable portion of the seat;

a sleeve member positionable over said pivot shaft, said sleeve member having a plurality of apertures extending through at least one wall of said sleeve member, each aperture being threaded;

a plurality of set screw members, each one of said plurality of set screw members being positionable in an associated one of said plurality of apertures to secure said sleeve member to said pivot assembly;

a pair of height adjustment assemblies, each one of said pair of height adjustment assemblies being operationally coupled between an associated one of said pair of primary wheels and said frame, whereby a height of the frame above the ground is adjustable; and wherein each one of said pair of height adjustment assemblies each further comprise a plurality of apertures, said plurality of apertures being positioned in a vertical array.

* * * * *